US009125776B1

(12) United States Patent
Shih

(10) Patent No.: US 9,125,776 B1
(45) Date of Patent: Sep. 8, 2015

(54) ELECTRIC BED

(71) Applicant: Chuan-Hang Shih, Changhua County (TW)

(72) Inventor: Chuan-Hang Shih, Changhua County (TW)

( * ) Notice: Subject to any disclaimer, the term of this patent is extended or adjusted under 35 U.S.C. 154(b) by 0 days.

(21) Appl. No.: 14/590,660

(22) Filed: Jan. 6, 2015

(30) Foreign Application Priority Data

Jul. 15, 2014 (TW) ..... 103212551 U

(51) Int. Cl.
*A61G 7/018* (2006.01)
*A61G 7/015* (2006.01)

(52) U.S. Cl.
CPC ..... *A61G 7/018* (2013.01); *A61G 7/015* (2013.01)

(58) Field of Classification Search
CPC ..... A61G 7/018; A61G 7/015; A47C 20/041
USPC ..... 5/610–619
See application file for complete search history.

(56) References Cited

U.S. PATENT DOCUMENTS 238,799 A * 3/1881 Morgan ..... 5/619
791,295 A * 5/1905 Sennett ..... 5/618
806,091 A * 12/1905 Andrews ..... 5/617
3,317,931 A * 5/1967 Benoit et al. ..... 5/616
4,494,259 A * 1/1985 Miller et al. ..... 5/616
6,789,280 B1 * 9/2004 Paul ..... 5/617
7,810,189 B2 * 10/2010 Boudreau ..... 5/618
8,418,290 B2 * 4/2013 Shih ..... 5/616
8,615,828 B2 * 12/2013 Schermel ..... 5/618
2002/0056162 A1 * 5/2002 Flynn et al. ..... 5/611
2004/0034935 A1 * 2/2004 Ferneau et al. ..... 5/618
2005/0204474 A1 * 9/2005 Knipfel ..... 5/620
2005/0257319 A1 * 11/2005 Ikeda et al. ..... 5/618
2006/0031990 A1 * 2/2006 Palmatier et al. ..... 5/611
2006/0112488 A1 * 6/2006 Lemire et al. ..... 5/617
2007/0169269 A1 * 7/2007 Wells ..... 5/618
2011/0094032 A1 * 4/2011 Shih ..... 5/614
2012/0096645 A1 * 4/2012 Shih ..... 5/614
2012/0198628 A1 * 8/2012 Richards ..... 5/618
2012/0240337 A1 * 9/2012 Shih ..... 5/616
2014/0237723 A1 * 8/2014 Wysocki et al. ..... 5/613

* cited by examiner

*Primary Examiner* — David E Sosnowski
*Assistant Examiner* — Ifeolu Adeboyejo
(74) *Attorney, Agent, or Firm* — Muncy, Geissler, Olds & Lowe, P.C.

(57) ABSTRACT

An electric bed includes a base support frame and an end frame pivotally connected with the base support frame, such that the end frame can be turned downwardly from a horizontal position and restored to the horizontal position by a position-restoring device. A driving member has two ends pivotally connected with the base support frame and a rotatable frame, respectively. The rotatable frame has a front end pivotally connected with a rear end of the base support frame and positioned above the end frame, and a pushing plate connected with the driving member directly or indirectly. Therefore, the driving member can drive the rotatable frame to press the end frame to turn downwardly from the horizontal position. The position-restoring device returns the end frame to the horizontal position while the end frame is not acted by the driving member.

8 Claims, 9 Drawing Sheets

ELECTRIC BED

BACKGROUND

1. Technical Field

The present disclosure is relates to a bed, in particular to an electric bed. The electric bed has a bed frame covering on the peripheral of a bedstead thereof, and an end frame of the bed frame can be turned downwardly, such that the electric bed has advantages of high security, succinct exterior appearance and multifunction.

2. Description of Related Art

Many traditional electric beds have the function of raising head portion or foot portion. In order to improve the comfort in usage, the structural improvement and function design advance rapidly. For example, U.S. Pat. No. 8,209,801 discloses a leg lift mechanism 50 for an electric chair or an electric bed. The leg lift mechanism 50 includes a second structural component 12 and a third structural component 13 pivotally connected with each other to support a user's thighs and lower legs. The leg lift mechanism 50 can drive the third structural component 13 to turn upwardly to cause the electric bed to change from the status of FIG. 1 to the status of FIG. 3 of the patent, such that the user's lower leg is lifted from a little downward inclination status to an extent flush with user's thigh at the same horizontal level. In addition, the leg lift mechanism 50 further drives the second structural component 12 to turn upwardly as shown in FIG. 4 of the patent, so that the user's thigh can be lifted; therefore, the user can adjust most appropriate angle of the electric bed to increase the comfort in usage.

However, if an external object enters the leg lift mechanism 50, or a child extends hand or leg into the leg lift mechanism 50 mistakenly, it possibly causes accident such as the electric bed being damaged or the child getting hurt. Therefore, if a bed frame can be added on the peripheral of the electric bed, the inner structure of the electric bed can be protected and the usage security for the user can be improved, and the electric bed also has a more succinct exterior appearance; however, the bed frame is a fixed structure, which will not affect the action of the electric bed shown in FIG. 4 of the patent, but may cause the electric bed hard to reach the status shown in FIG. 1 of the patent. That is, if a fixed bed frame is applied to the conventional electric bed, the electric bed may not have the function of making user's lower leg downward. Therefore, what is need is to develop an electric bed having all of using security, beautiful appearance and multifunction.

SUMMARY

An exemplary embodiment of the present disclosure provides an electric bed. A bed frame is formed on the peripheral of the electric bed and includes a base support frame and an end frame that can be turned downwardly and restored, such that the electric bed has the advantages of high security, succinct exterior appearance and multifunction.

According to one exemplary embodiment of the present disclosure, the electric bed includes a base support frame, an end frame, a position-restoring device, a driving member, and a rotatable frame. The base support frame has a rear end and a stop portion at the rear end. The end frame has a front end rotatably connected with the rear end of the base support frame, and an abutment portion at the front end of the end frame. The end frame can be turned downwardly relative to the base support frame from a first position. When the end frame stays at the first position, the abutment portion abuts against the stop portion of the base support frame to prohibit the end frame from turning upwardly from the first position. The position-restoring device provides a preload for restoring the end frame to the first position. The driving member has a cylinder with an end pivotally connected with the base support frame, and an actuation rod extendably and retractably disposed in the cylinder. The rotatable frame has a front end rotatably connected with the rear end of the base support frame, a pressing member, and a pushing plate connected with the actuation rod of the driving member directly or indirectly.

When the actuation rod of the driving member is retracted to the cylinder, the pushing plate is pulled to turn the rotatable frame downwardly relative to the base support frame, so as to enable the pressing member of the rotatable frame to press the end frame, causing the end frame to turn downwardly relative to the base support frame from the first position. Therefore, the electric bed can have advantages of high security, succinct exterior appearance and multifunction.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
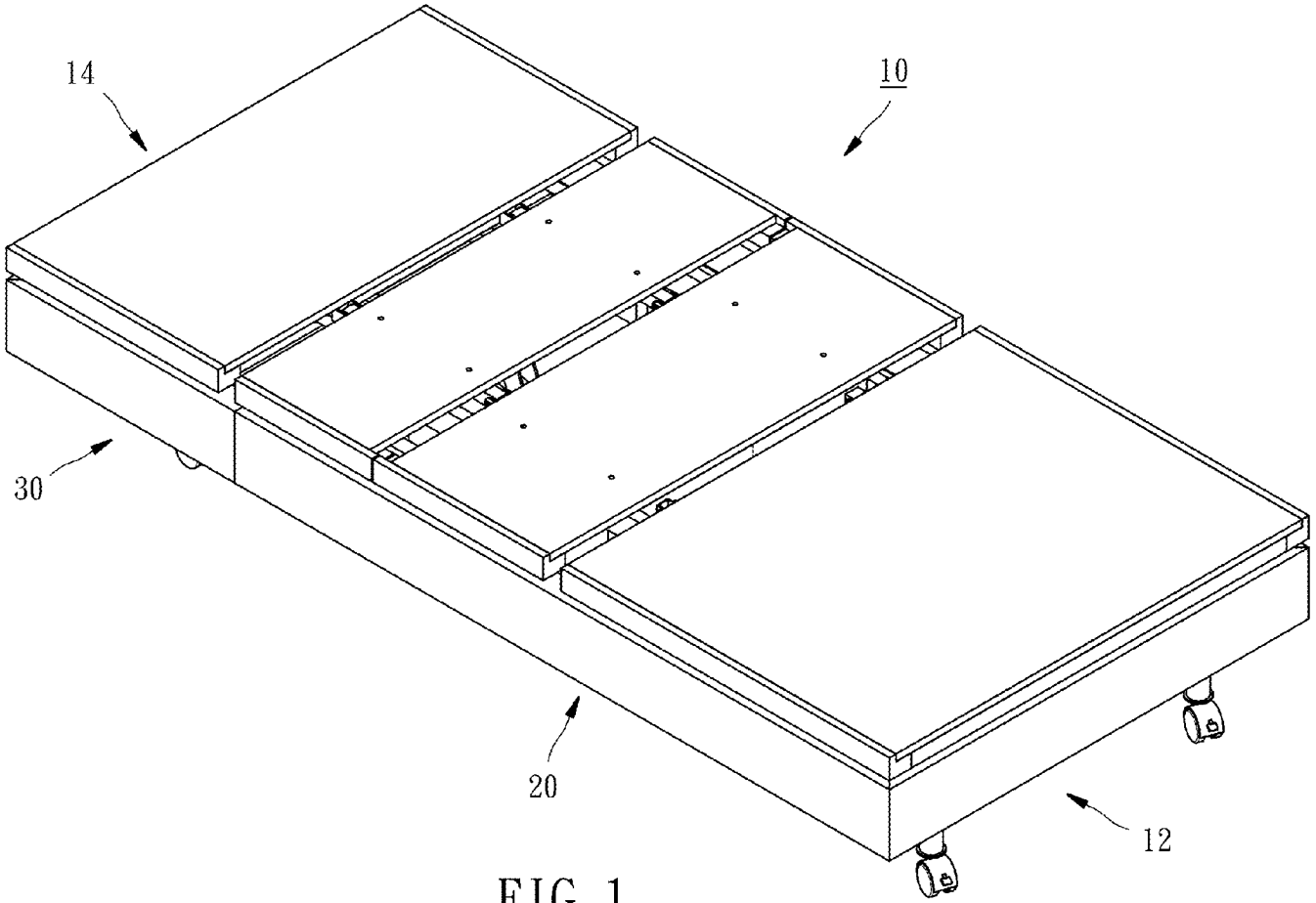
FIG. 1 is a perspective view of a first preferred embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

Figure 6:
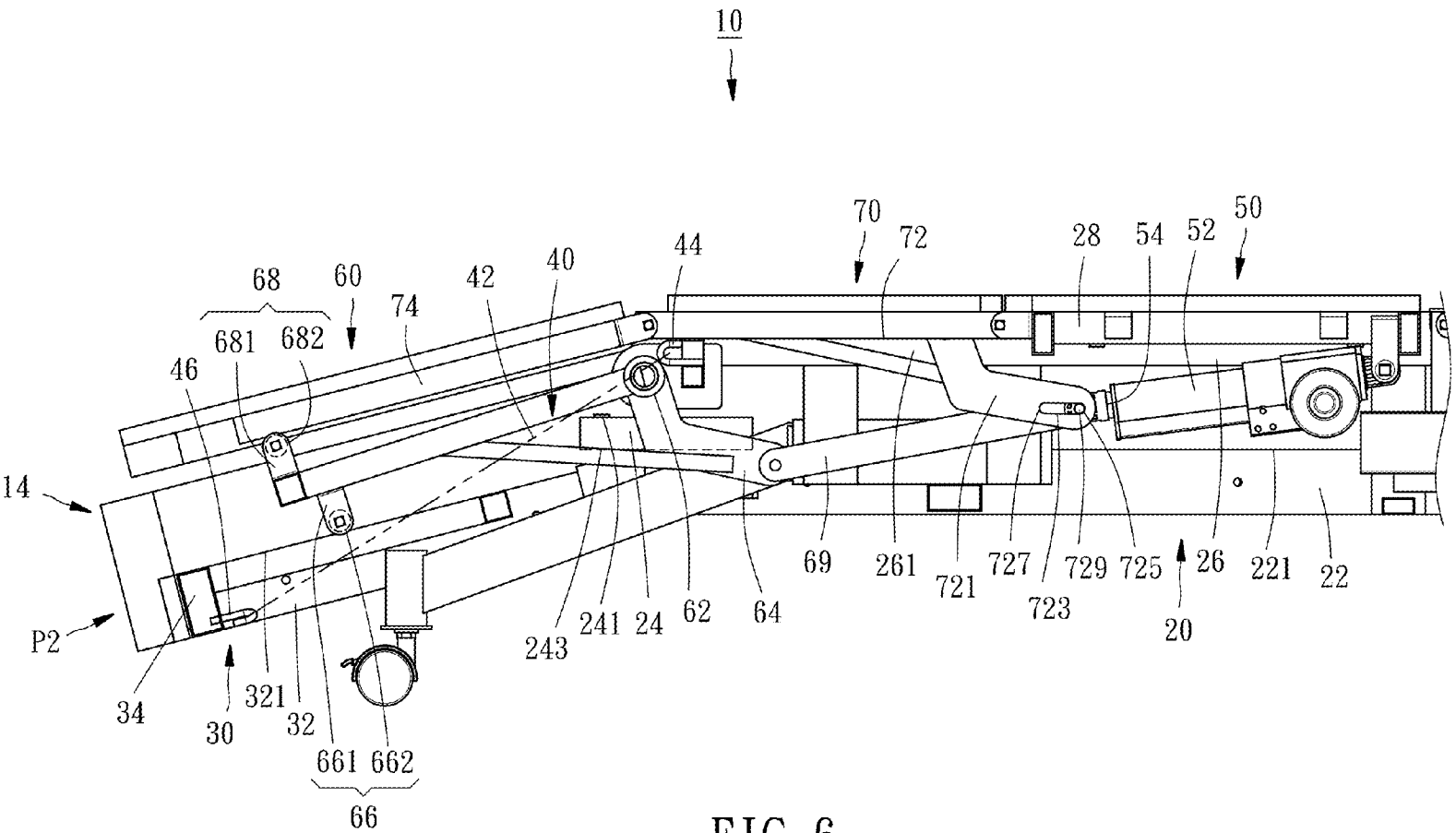
FIG. 6 and FIG. 7 are views showing different actions of the first preferred embodiment of the present disclosure.
Figure 8:
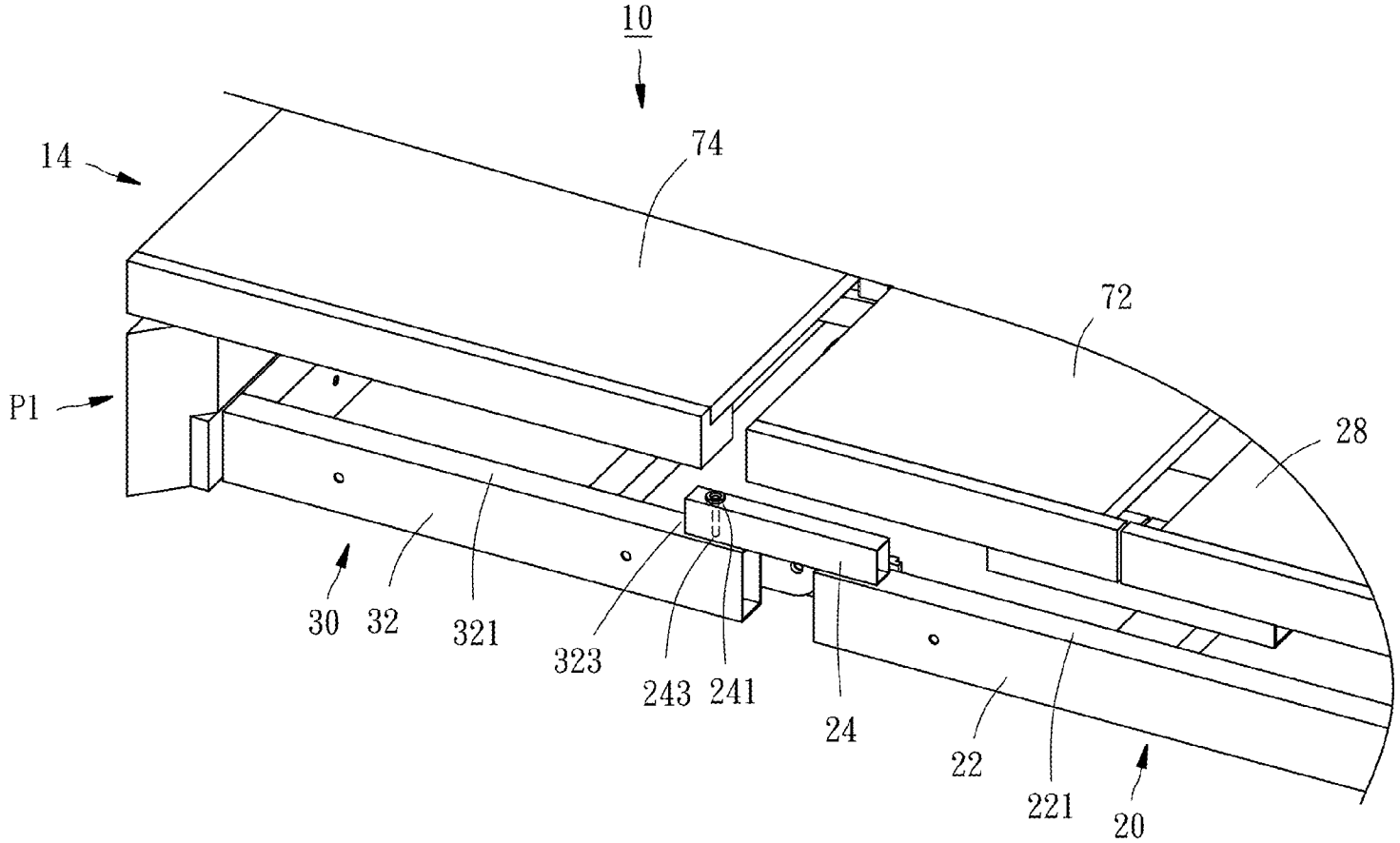
FIG. 8 is a partially perspective view of the foot portion of the first preferred embodiment of the present disclosure.

Referring to FIG. 1, FIG. 6 and FIG. 8, an electric bed 10 provided by the first preferred embodiment of the present disclosure includes a base support frame 20, an end frame 30, a position-restoring device 40, a driving member 50, a rotatable frame 60 and a connection assembly 70. In the following embodiment of the present disclosure, a bed head 12 of electric bed 10 is defined as the front direction, and a foot portion 14 is defined as the back or rear direction, i.e. the direction along the bed head 12 and the foot portion 14 is defined as a longitudinal direction.

Figure 5:
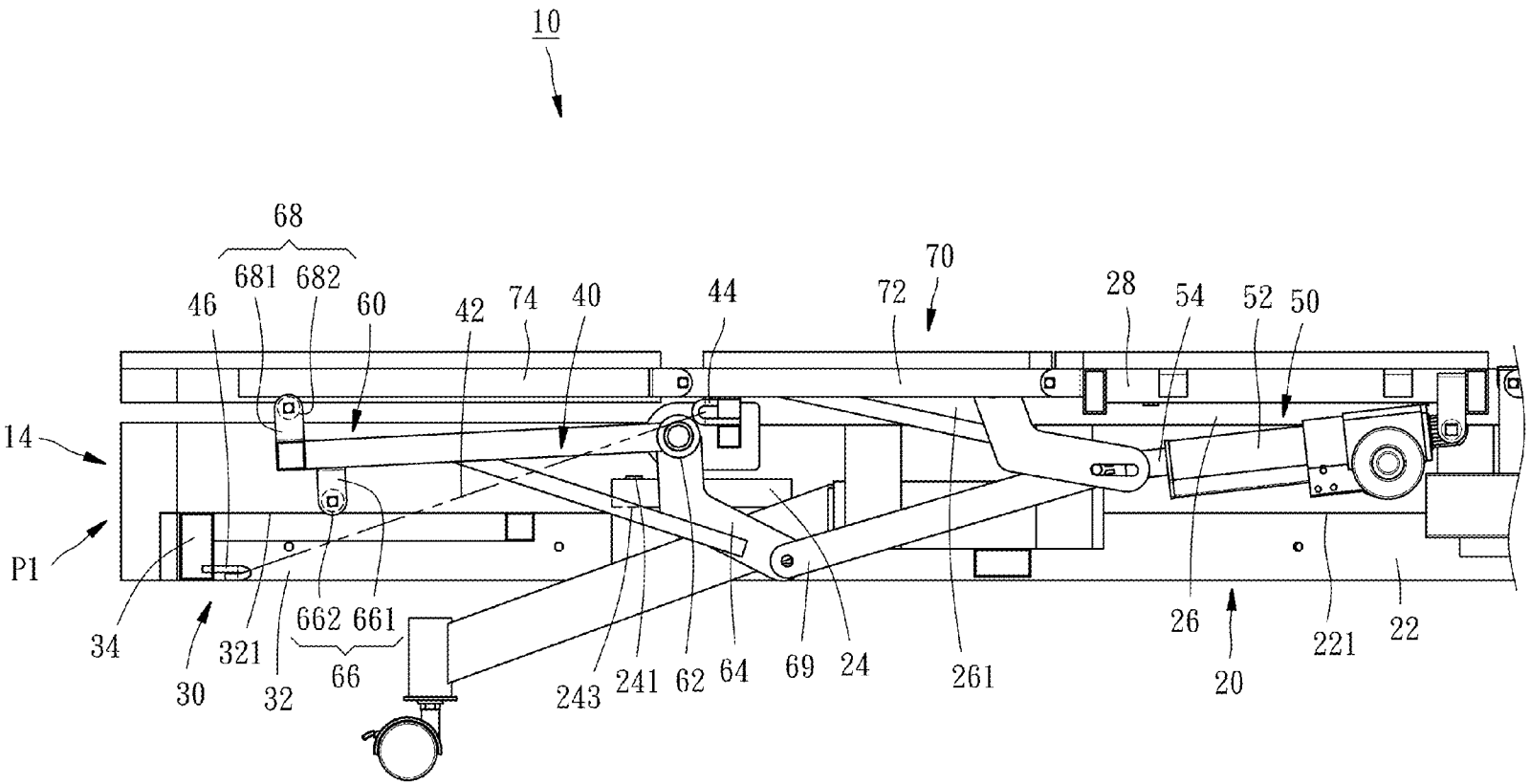
FIG. 5 is a partial front view of the first preferred embodiment of the present disclosure.
Figure 9:
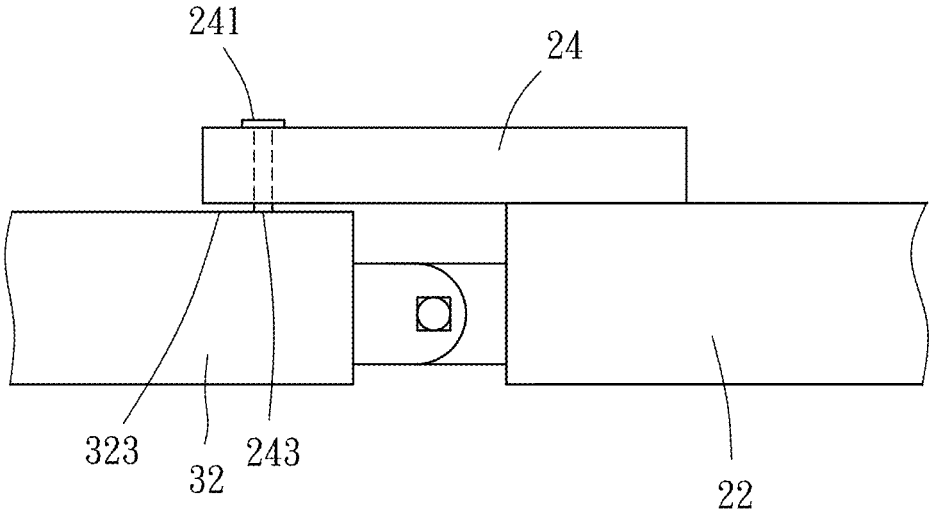
FIG. 9 is a partial front view of the foot portion of the first preferred embodiment of the present disclosure.

The base support frame 20 has two longitudinal rods 22 disposed in a parallel manner, two extension rods 24, two support rods 26 and a hip support 28. As shown in FIG. 5 and FIG. 8, each longitudinal rod 22 is extended along a longitudinal direction and has a top surface 221. The front end of each of the two extension rods 24 is disposed on the top surface 221 of the respective longitudinal rod 22, and the rear end of the extension rod 24 is overhung on a rear end of the longitudinal rod 22. An adjusting bolt 241 is screwed at the rear end of the extension rod 24 and the bottom end of the adjusting bolt 241 is protruded out of the bottom surface of the extension rod 24, as shown in FIG. 9. The two support rods 26 are disposed above the two longitudinal rods 22 by the several supports. The hip support 28 is mounted on the two support rods 26, and each of the two support rods 26 has a support portion 261 at the rear end thereof.

The end frame 30 has two side rods 32 disposed in a parallel manner and extended along the longitudinal direction, and a transverse rod 34 connected with the rear ends of the two side rods 32. As shown in FIG. 8, the rear end of each longitudinal rod 22 of the base support frame 20 is pivotally connected with the front end of the corresponding side rod 32 of the end frame 30. Each of the side rods 32 has a top surface 321, and each of the two top surfaces 321 has an abutment portion 323 at the front end thereof, and the rear end of the extension rod 24 is positioned above the abutment portion 323. A stop portion 243 is formed by the bottom end of the adjusting bolt 241 of the extension rod 24, as shown in FIG. 9, i.e. the stop portion 243 is positioned at the rear end of the base support frame 20. When the end frame 30 stays at a first position P1, i.e. substantially horizontal status as shown in FIG. 5 and FIG. 8), the abutment portion 323 of the end frame 30 abuts against the stop portion 243 of the base support frame 20, such that the end frame 30 cannot be turned upwardly from the first position P1. In addition, the vertical position of the adjusting bolt 241 can be adjusted upon user's demand to control the height of a limit position (i.e. the first position P1) during the upward turn of the end frame 30.

The structure of the base support frame 20 can be varied, for example, the adjusting bolt 241 can be omitted and the abutment portion 323 of the end frame 30 may abut the bottom surface of the extension rod 24 directly when the end frame 30 is at the first position P1. In this case, the bottom surface of the extension rod 24 is defined as the stop portion 243. The extension rod 24 may be only one in number or may be omitted. For example, the two longitudinal rods 22 may be further extended backward at a distance and the two side rods 32 are extended forward at a distance in such a way that when the end frame 30 is at horizontal status or at the first position P1, the end surfaces of the front ends of the two side rods 32 abut against the end surfaces of the rear ends of the two longitudinal rods 22 directly, prohibiting the end frame 30 from being turned upwardly. In this case, the end surfaces of the rear ends of the two longitudinal rods 22 serve as the stop portions 243, and the end surfaces of the front ends of the two side rods 32 serve as the abutment portions 323. Actually, the variations of the structure of the base support frame 20 are too many to be illustrated completely, and the stop portion 243 can also be represented by different types. The necessary feature of the present disclosure is that the base support frame 20 has a stop portion 243 at the rear end thereof to be abutted by the abutment portion 323 of the end frame 30.

Figure 2:
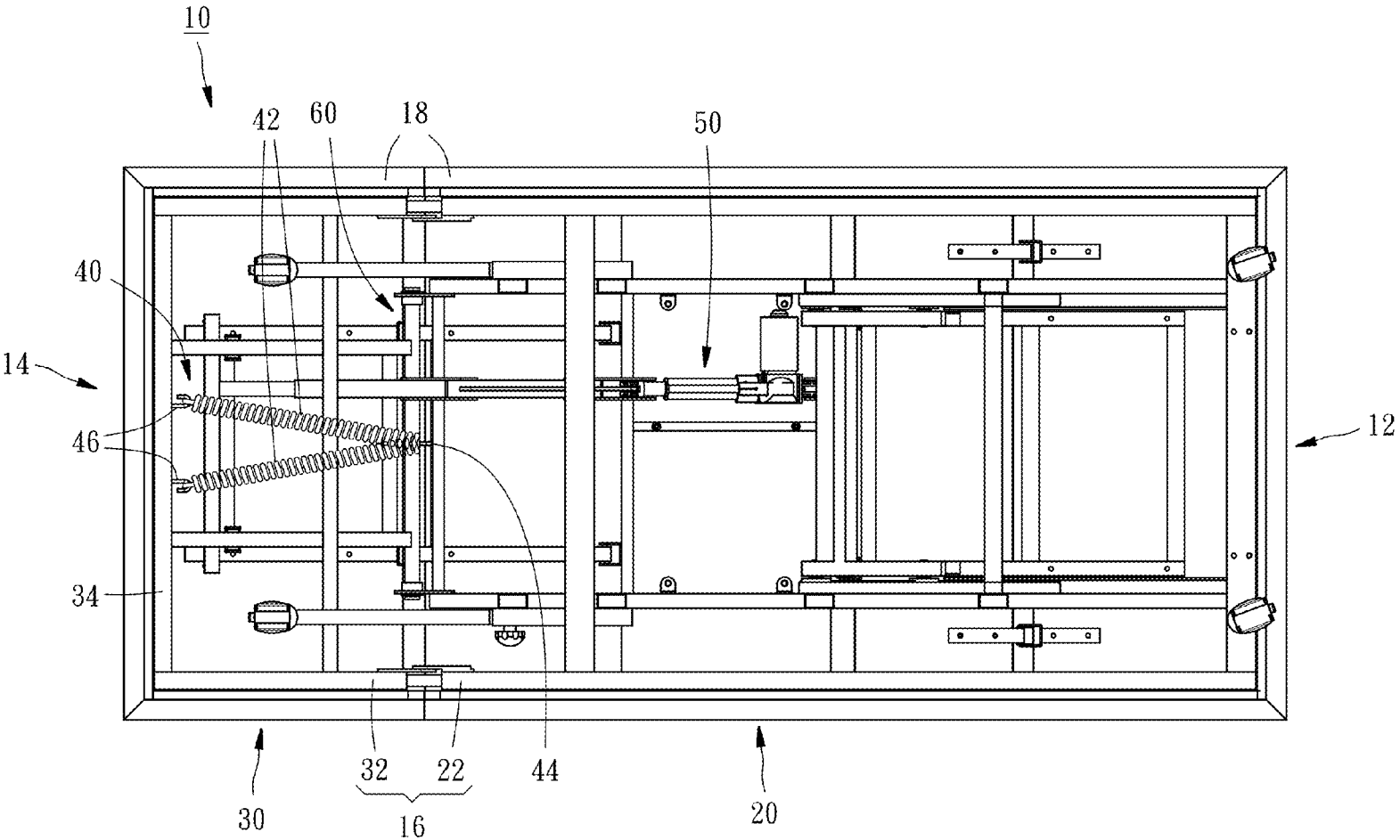
FIG. 2 is a bottom view of the first preferred embodiment of the present disclosure.

As shown in FIG. 2 and FIG. 5, the position-restoring device 40 has two elastic members 42, a first hook 44 disposed at a rear end of the base support frame 20, and two second hooks 46 disposed at the transverse rod 34 of the end frame 30. The first hook 44 is positioned between the two longitudinal rods 22 and above the stop portion 243. The front ends of the two elastic members 42 are hooked on the first hook 44, and the rear ends of the two elastic members 42 are hooked on the two second hooks 46, respectively. The function of the position-restoring device 40 is to provide a preload for upward turn of the end frame 30 from a second position P2 as shown in FIG. 6 or other position to the first position P1 as shown in FIG. 5, and any means to achieve this objective are covered by the claimed range of the present disclosure. For example, the elastic member 42 can be an elastic component such as spring or rubber, and can be at least one in number. The hooks 44 and 46 are not limited in number, for example, the front ends of the elastic members 42 can be hooked on two first hooks 44 respectively, or the rear ends of the elastic members 42 can be hooked on a second hook 46 together; the first hook 44 and the second hook 46 can be replaced by holes respectively disposed on the base support frame 20 and the end frame 30 to be hooked by the elastic members 42. Actually, so long as the two ends of the elastic members 42 can be respectively mounted to the base support frame 20 and the end frame 30, the structure and position of the connection are not limited. In addition, the position-restoring device 40 can include a torque spring disposed at the pivotal connection place between the base support frame 20 and the end frame 30, so as to provide a preload for the upward turn of the end frame 30; alternately, a front end and a rear end of an U-shaped spring clip can be disposed on the bottom end of the base support frame 20 and the bottom end of the end frame 30, so as to provide an elastic force for the end frame 30 to turn upwardly to the first position P1 (as shown in FIG. 5) after the end frame 30 is turned downwardly from the first position P1. In addition, the position-restoring device 40 can also be implemented by other manners which will be described in the following paragraph.

The driving member 50 has a cylinder 52 and an actuation rod 54. A front end of the cylinder 52 is pivotally connected with the hip support 28 of the base support frame 20, and the actuation rod 54 is extendably and retractably disposed in the cylinder 52 and can be protruded backward from the rear end of the cylinder 52, as shown in FIG. 5. The driving member 50 can be an electric motor, a pneumatic apparatus such as a pneumatic cylinder, or an oil pressure apparatus such as oil hydraulic cylinder, but the present disclosure is not limited thereto. The front end of the cylinder 52 can be pivotally connected with other appropriate place of the base support frame 20, and not limited to be connected with the hip support 28.

The rotatable frame 60 has a pivot portion 62 pivotally connected with the rear end of the base support frame 20, two pushing plates 64, two pressing members 66 positioned under the rear end of the rotatable frame 60, and two supporting members 68 positioned above the rear end of the rotatable frame 60, as shown in FIG. 5. The pivot portion 62 is positioned at a front end of the rotatable frame 60. A rear end of each of the pushing plates 64 is mounted to the bottom of the pivot portion 62, and a front end of each of the pushing plates 64 is pivotally connected with a rear end of a linkage 69. A front end of the linkage 69 is connected with the rear end of the actuation rod 54, such that the rotatable frame 60 and the driving member 50 are indirectly connected together by the linkage 69, resulting in that the rotatable frame 60 can be driven to turn upwardly or downwardly by the driving member 50. Each pressing member 66 and each supporting member 68 has a roller 662 and 682 rotatably mounted between two lugs 661 and between two lugs 681, respectively. The supporting member 68 is not the necessary feature of the present disclosure and can be omitted. The pressing member 66 is used to selectively press against the end frame 30 and is not limited to the above-mentioned structure. For example, the pressing member 66 may be a protruding block or any portion contacting with the end frame 30.

The connection assembly 70 has a thigh support 72 and a lower leg support 74. As shown in FIG. 6, a front end of the thigh support 72 is pivotally connected with a rear end of the hip support 28, and a rear end of the thigh support 72 is pivotally connected with a front end of the lower leg support 74. The thigh support 72 has two pushing plates 721 extended downwardly and toward the driving member 50, and two elongated slots 723 disposed at the front end of the pushing plate 721. Each of the elongated slots 723 has a front end 725 and a rear end 727, and the actuation rod 54 is pivotally connected with the linkage 69 via a control pin 729 disposed within the elongated slots 723. The connection assembly 70 is not a necessary component of the present disclosure and just to assist the illustration of the first preferred embodiment.

When the actuation rod 54 starts to retract into inside of the cylinder 52 from the status shown in FIG. 5, the control pin 729 is correspondingly driven to slide from the rear ends 727 of the elongated slots 723 to the front ends 725 of the elongated slots 723, and pulls the two pushing plates 64 via the linkage 69, such that the rotatable frame 60 is turned downwardly relative to the base support frame 20 about the pivot portion 62 to enable the roller of the pressing member 66 to press against the side rod 32 or other portion of the end frame 30 downwardly, resulting in that the end frame 30 can be turned downwardly from the first position P1 to the second position P2, as shown in FIG. 6. On the other hand, because the supporting member 68 of the rotatable frame 60 supports the lower leg support 74 to maintain the horizontal status as shown in FIG. 5, when the rotatable frame 60 is turned downwardly, the lower leg support 74 is correspondingly turned downwardly due to gravity, such that the electric bed 10 has the function of swinging the lower leg support 74 downwardly from horizontal level. On the contrary, when the actuation rod 54 is protruded backward from the status shown in FIG. 6, the control pin 729 is driven correspondingly to slide from the front ends 725 of the elongated slots 723 to the rear ends 727, and the two pushing plates 64 are pushed by the linkage 69 to enable the rotatable frame 60 to turn upwardly about the pivot portion 62; when the rotatable frame 60 is turned upwardly, the roller of the supporting member 68 pushes the lower leg support 74 to lift the lower leg support 74 to turn upwardly. On the other hand, the pressing member 66 does not exert pressing force on the end frame 30 anymore while the rotatable frame 60 is raised, so the end frame 30 is turned upwardly due to the preload of the position-restoring device 40 to restore to the first position P1 until the abutment portion 323 of the end frame 30 abuts against the stop portion 243 of the base support frame 20. At this situation, the end frame 30 is prohibited from turning upwardly from the first position P1 any more, as shown in FIG. 5.

Figure 7:
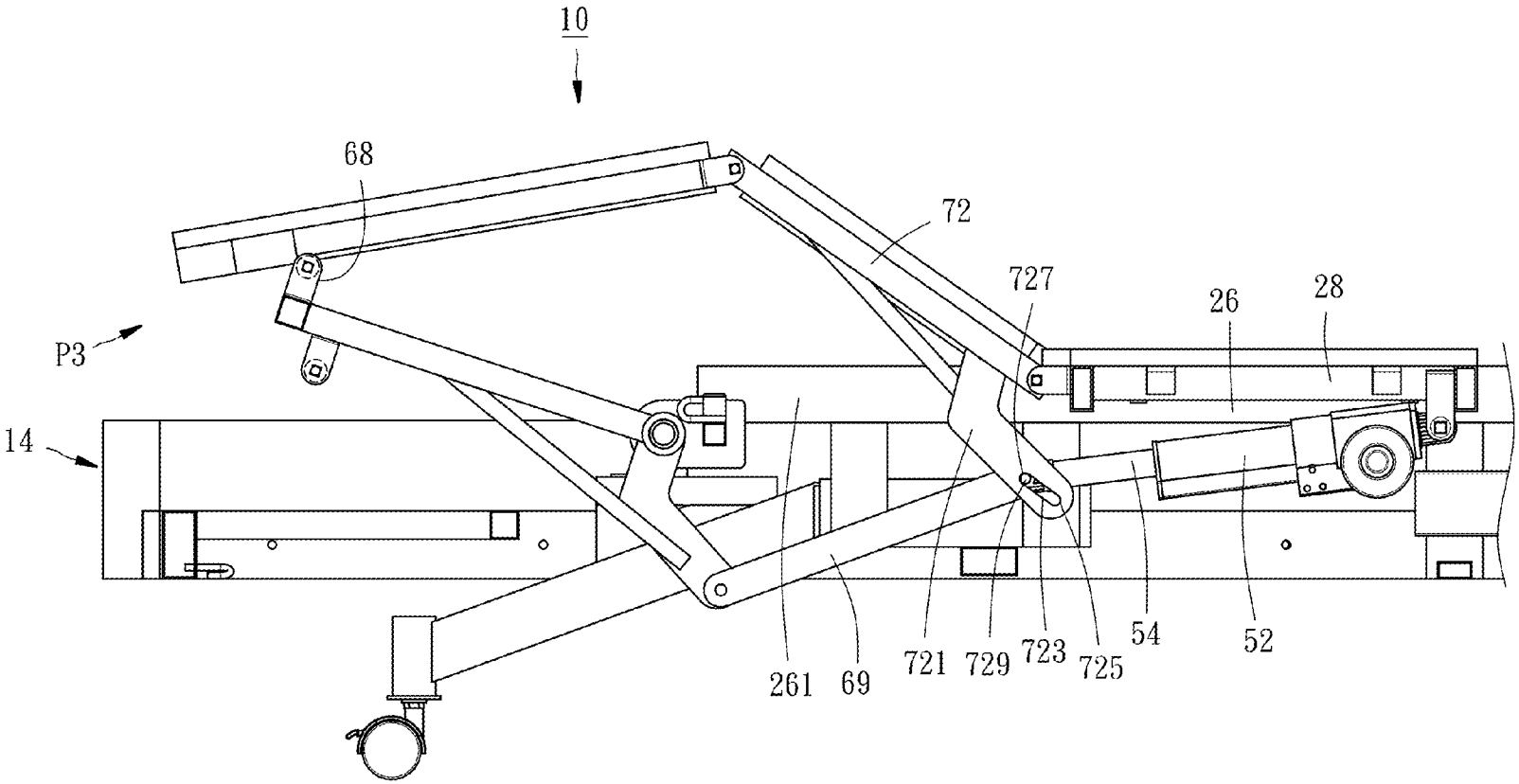

Next, when the actuation rod 54 is kept protruding backward from the cylinder 52, as shown in FIG. 7, the actuation rod 54 will push the two pushing plates 721 backwardly via the control pin 729 to cause the thigh support 72 to turn upwardly relative to the base support frame 20, and at the same time the actuation rod 54 also push the rotatable frame 60 via the linkage 69 to cause the rotatable frame 60 to turn upwardly. The rear end of the lower leg support 74 is then raised by the supporting member 68 of the rotatable frame 60, such that the electric bed 10 can have the function of raising the thigh support 72 and the lower leg support 74. On the contrary, when the actuation rod 54 is retractably returned to the cylinder 52 from the status shown in FIG. 7, the thigh support 72 is turned downwardly due to the action of gravity. Because the two support portions 261 of the base support frame 20 are disposed under the thigh support 72, the thigh support 72 is stopped acting downwardly while abutting against the support portions 261 at the horizontal position, as shown in FIG. 5.

Figure 3:
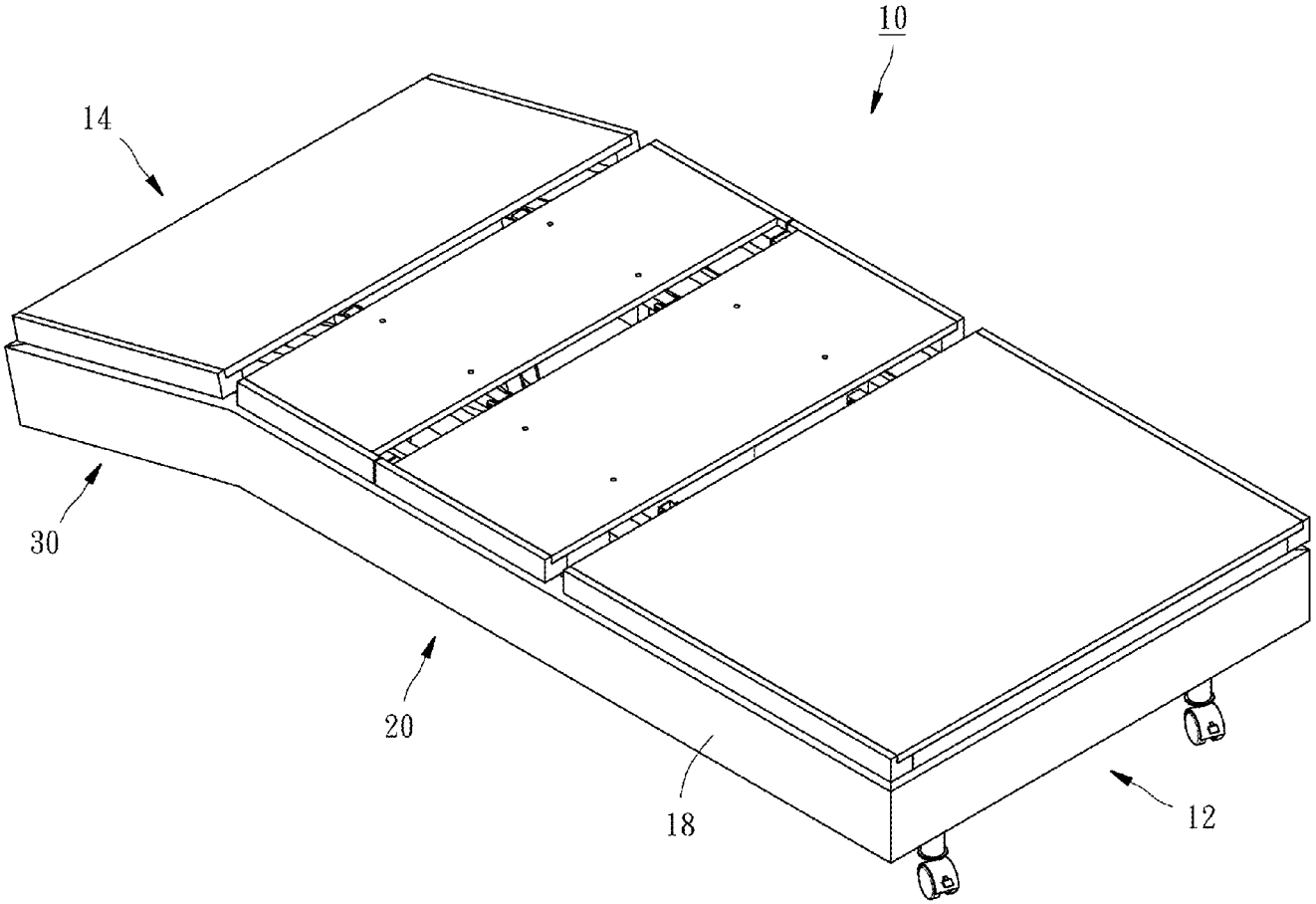
FIG. 3 and FIG. 4 are views showing the action of the first preferred embodiment of the present disclosure.
Figure 4:
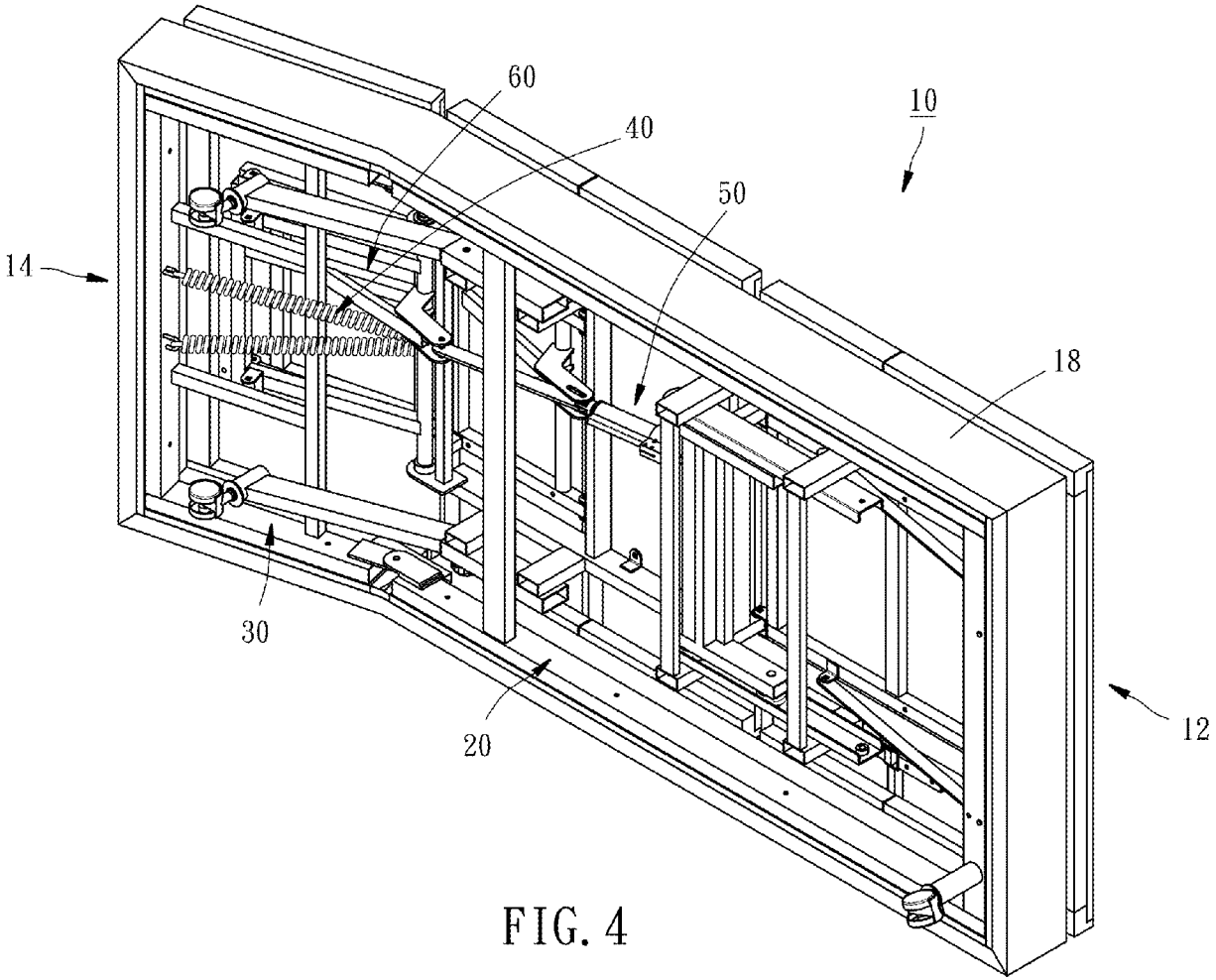

In present disclosure, an outer frame of the base support frame 20 and an outer frame of the end frame 30 are formed combinedly a bed frame 16 which is disposed on the peripheral of the electric bed 10, as shown in FIG. 2, so that the bed frame 16 can not only cover the structures such as the position-restoring device 40, the driving member 50 and the rotatable frame 60 to improve the security in usage, but also has a succinct exterior appearance. A cushion 18 can also be added on the peripheral of the bed frame 16 to further improve the security and comfort. In addition, the end frame 30 of the bed frame 16 can further have the function of being turned downwardly and being restored, so the function of turning the lower leg support 74 downwardly in the electric bed 10 is not limited by the bed frame 16, as shown in FIG. 3 and FIG. 4. The problem of sacrificing the function of turning downwardly the lower leg support in order to add bed frame in the traditional electric bed can be solved. Therefore, the electric bed of the present disclosure can have both advantages of high security, succinct exterior appearance and multifunction.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure. For example, the pushing plate 64, the pushing plate 721, the pressing member 66 or the supporting member 68 can be at least one in number; the pressing member 66 or the supporting member 68 can be provided without roller 662 or 682 upon demand; the linkage 69 is not the necessary component for coupling of the driving member 50 and the rotatable frame 60, i.e. the front end of the pushing plate 64 can be pivotally connected with the rear end of the actuation rod 54 directly. The first hook 44 of the position-restoring device 40 can be disposed at the bottom surface of the lower leg support 74 or the thigh support 72. Further, magnetic members being attractable to each other can be disposed on the top surface 321 of the end frame 30 and bottom surface of the lower leg support 74 respectively, to provide an attraction force for restoring the end frame 30 to the first position P1 from the second position P2 or other position.

What is claimed is:

1. An electric bed, comprising:

a base support frame having a rear end and a stop portion at the rear end;

an end frame having a front end rotatably connected with the rear end of the base support frame, and an abutment portion at the front end of the end frame, the end frame being rotatable downwardly relative to the base support frame from a first position, wherein when the end frame stays at the first position, the abutment portion abuts against the stop portion of the base support frame to prohibit the end frame from turning upwardly from the first position;

a position-restoring device providing a preload for restoring the end frame to the first position;

a driving member having a cylinder with an end pivotally connected with the base support frame, and an actuation rod extendably and retractably disposed in the cylinder; and a rotatable frame having a front end rotatably connected with the rear end of the base support frame, a pressing member, and a pushing plate connected with the actuation rod of the driving member directly or indirectly;

wherein when the actuation rod of the driving member is retracted to the cylinder, the pushing plate is pulled to turn the rotatable frame downwardly relative to the base support frame, so as to enable the pressing member of the rotatable frame to press the end frame, causing the end frame to turn downwardly relative to the base support frame from the first position.

2. The electric bed as defined in claim 1, wherein the base support frame comprises two longitudinal rods disposed in parallel, and the end frame comprises two side rods disposed in parallel; a rear end of each of the longitudinal rods of the base support frame is pivotally connected with a front end of the respective side rod of the end frame; each of the longitudinal rods of the base support frame has a top surface; the base support frame further comprises an extension rod disposed on the top surface of one of the longitudinal rods, and extended backwardly to have its rear end be positioned above one of the side rods of the end frame; when the end frame is at the first position, a top surface of the side rod of the end frame abuts a bottom surface of the extension rod; the top surface of the side rod of the end frame serves as the abutment portion and the bottom surface of the extension rod serves as the stop portion.

3. The electric bed as defined in claim 2, wherein the extension rod further has an adjusting bolt having a bottom end that serves as the stop portion.

4. The electric bed as defined in claim 1, wherein the position-restoring device has at least one elastic member having two ends mounted to the base support frame and the end frame, respectively.

5. The electric bed according to claim 4, wherein a front end of the elastic member is mounted to the base support frame and located above the stop portion.

6. The electric bed as defined in claim 1, wherein a rear end of the actuation rod of the driving member is pivotally connected with the pushing plate of the rotatable frame directly.

7. The electric bed as defined in claim 1, wherein a rear end of the actuation rod of the driving member is connected with a front end of a linkage, and a rear end of the linkage is pivotally connected with the pushing plate of the rotatable frame, so that the pushing plate of the rotatable frame and the actuation rod of the driving member are connected indirectly.

8. The electric bed as defined in claim 7, further comprising a thigh support having a front end pivotally connected with the base support frame, a pushing plate extending downwardly, and an elongated slot disposed at a front end of the pushing plate of the thigh support; wherein the actuation rod of the driving member is pivotally connected with the linkage via a control pin; the control pin is contained within the elongated slot of the thigh support; the elongated slot has a front end and a rear end; when the control pin abuts against the rear end of the elongated slot and the actuation rod of the driving member is kept protruding backward from the cylinder, the thigh support is driven by the driving member to turn upwardly relative to the base support frame; wherein the base support frame further comprises a support portion positioned under the thigh support; when the thigh support is turned downwardly to a horizontal position, the thigh support abuts against the support portion and is prohibited from turning downwardly.

* * * * *